United States Patent [19]

Kupersmit

[11] Patent Number: 4,860,912

[45] Date of Patent: Aug. 29, 1989

[54] COLLAPSIBLE CARGO CONTAINER FOR AIRCRAFT

[76] Inventor: Julius B. Kupersmit, 299 W. 12th St., New York, N.Y. 10014

[21] Appl. No.: 205,234

[22] Filed: Jun. 10, 1988

[51] Int. Cl.[4] ..... B65D 87/14

[52] U.S. Cl. ..... 220/1.5; 229/23 R; 229/41 R; 206/600

[58] Field of Search ..... 220/1.5, 4 F; 229/23 R, 229/41 R; 206/600, 597

[56] References Cited

U.S. PATENT DOCUMENTS

| | | | |
|---|---|---|---|
| 3,556,448 | 1/1971 | Dobbs | 206/597 |
| 3,972,437 | 8/1976 | Lovich | 220/1.5 |
| 4,046,277 | 9/1977 | Morrison | 220/1.5 |
| 4,428,491 | 1/1984 | Mittelmann | 220/1.5 |

FOREIGN PATENT DOCUMENTS

| | | | |
|---|---|---|---|
| 2257297 | 11/1972 | Fed. Rep. of Germany | 220/1.5 |

*Primary Examiner*—Stephen Marcus
*Assistant Examiner*—Gilbert W. Reece
*Attorney, Agent, or Firm*—Charles E. Temko

[57] ABSTRACT

An improved collapsible shipping container adapted to conform to the configuration of a storage area in an aircraft fuselage. The container includes a removable dome-shaped roof element supported by a pair of combination side wall and door elements, which are detachably secured along the continuous lower edges thereof to a slip sheet.

2 Claims, 3 Drawing Sheets

COLLAPSIBLE CARGO CONTAINER FOR AIRCRAFT

BACKGROUND OF THE INVENTION

This invention relates generally to the field of collapsible reusable shipping containers, and more particularly, to an improved form thereof suited for aircraft use within a cargo compartment having a non-planar roof line.

Most commercial aircraft used for shipping cargo have fuselages of circular or ovate cross-section for reasons related to aerodynamics. Within this shape, a horizontal deck or floor is provided to support cargo. The area beneath the floor may be used for fuel storage and the like. The curved roof line of the cargo compartment has no planar ceiling, and unless containers are shaped to utilize the area immediately beneath the roof, this valuable cargo space is wasted.

It is known in the art to provide shipping containers having other than horizontal roof lines which are referred to as so-called "igloo" containers. Such containers have curved roof lines formed of molded materials, and while useful, they suffer from several disadvantages, the principal ones being high cost of manufacture, substantial weight, and, more importantly, they are normally not capable of being collapsed to flattened condition for storage or return shipment.

SUMMARY OF THE INVENTION

Briefly stated, the invention contemplates the provision of an improved collapsible shipping oontainer of the class described, in which the above mentioned disadvantages have been substantially eliminated. To this end, the disclosed embodiment comprises a lightweight slip sheet, which serves as a palate for forklift engagement. First and second wall and door elements have continuous lower edges which are secured to the upper surface of the slip sheet in either permanent or removable manner, the elements forming, when in erected condition, the side and end walls of the container with foldably connected front and rear double doors. The free upper edges of the elements are engaged by a multipanel roof element, a part of which completes a door opening at each end. Once loaded, the device is reinforced by plural strap elements, the ends of which are secured to rings on the slip sheet and which pass over the roof element.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
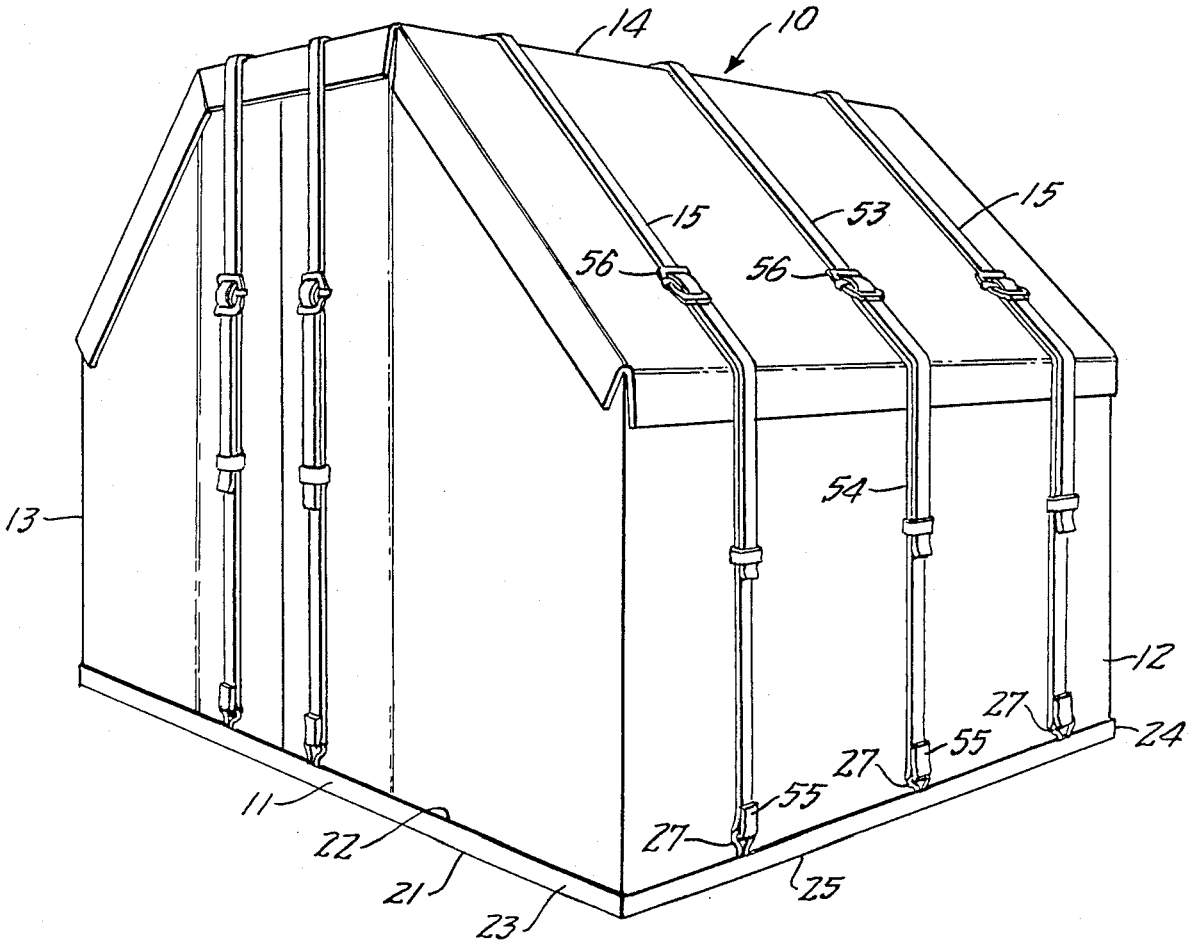
FIG. 1 is a view in perspective of an embodiment of the invention in fully erected condition.
Figure 2:
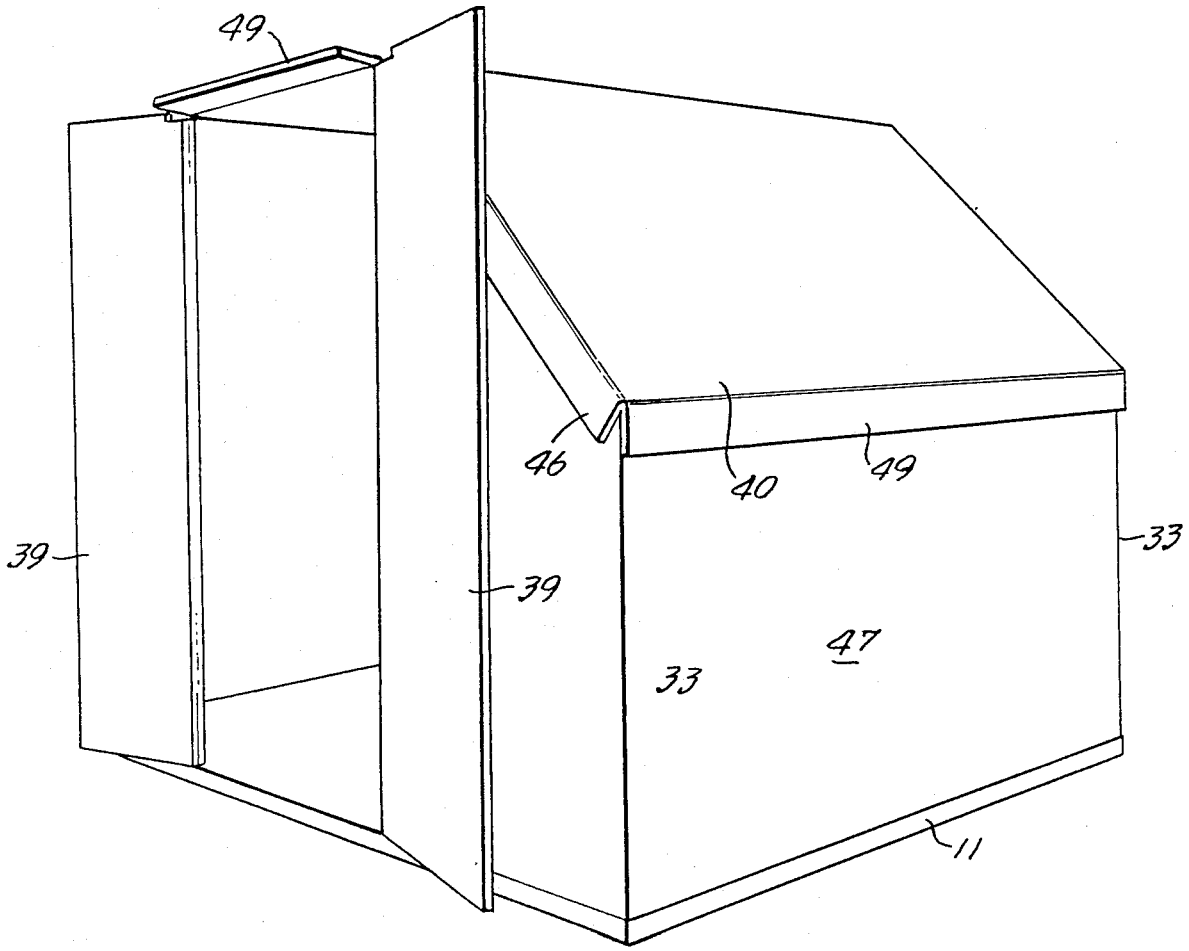
FIG. 2 is a similar view in perspective with reinforcing strap elements removed, and a first set of doors opened for loading.
Figure 3:
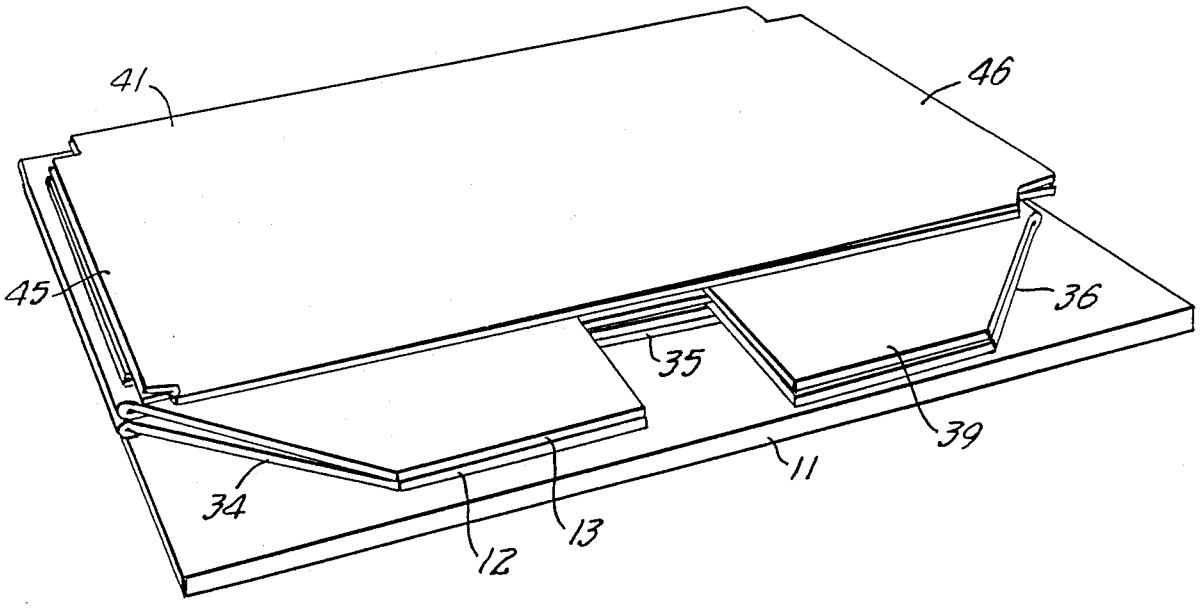
FIG. 3 is a view in perspective of the embodiment in collapsed condition with wall and roof elements in stacked relation upon a palate element for storage or return shipment.
Figure 4:
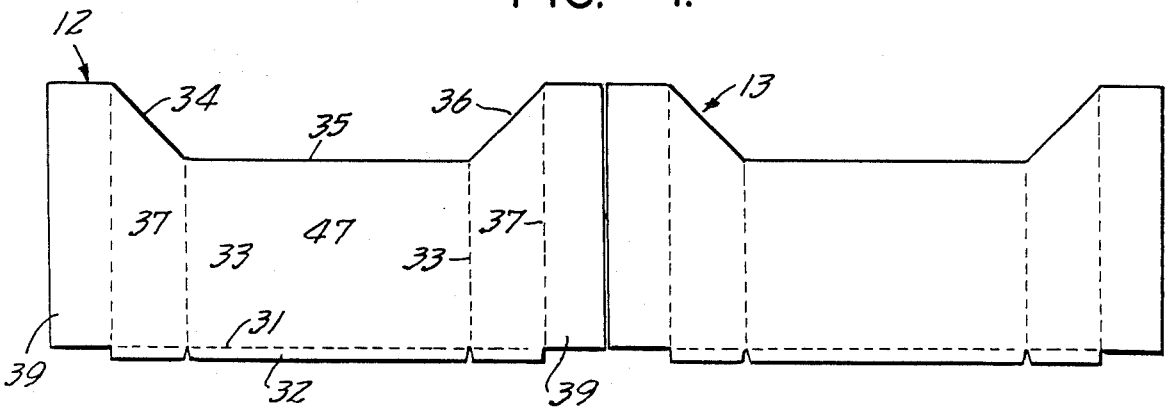
FIG. 4 is a developed view of a wall element comprising a part of the embodiment.
Figure 5:
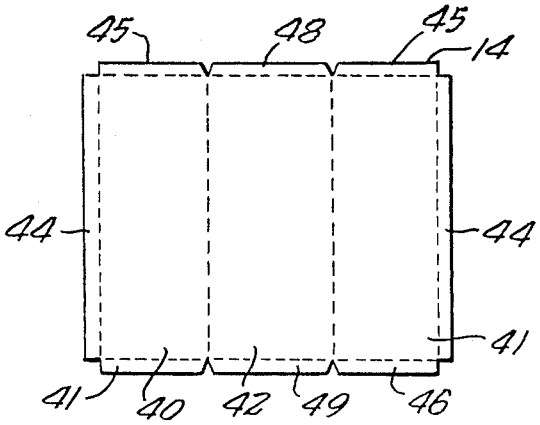
FIG. 5 is a developed view of a roof element forming part of the embodiment.

In accordance with the invention, the device, generally indicated by reference character 10, comprises broadly: a planar slip sheet element 11, first and second wall elements 12 and 13, a roof element 14, and a plurality of strap elements 15.

The slip sheet element 11 is of known construction, and comprises several layers of heavy duty corrugated board, with or without internal reinforcement. It is bounded by a lower surface 21, an upper surface 22, first and second end edges 23 and 24, as well as first and second side edges 25 and 26. Rings 27 for engaging the strap elements 15 are suitably secured at the side and end edges by suitable means not shown. In the alternative, a conventional wood pallet may be employed, which is somewhat more durable, but which has the disadvantages of added weight and thickness.

The first and second wall elements 12 and 13 are substantially identical,and are symmetrically arranged on the slip sheet element 11. The elements 12 and 13 are preferably formed as blanks of heavy duty corrugated material and include scored fold lines to form individual panels. Each element includes a continuous lower edge 31 having flap means 32 for interconnecting with the slip sheet element 11, preferably by fasteners which permit removal, to facilitate stackability. The element is also bounded by first and second vertical fold edges 33, and first, second and third upper edges, 34, 35, and 36. Fold edges 37 serve to interconnect rectangular doors 39 which are adapted to open outwardly.

The roof element 14 is also formed as a single blank of corrugated material, and includes first and second side panels 40 and 41 interconnected by a central panel 42. The panels 40 and 41 each include an end flap 44 and first and second side flaps 45 and 46, which are adapted to overlie the outer surfaces 47 of the wall elements 12 and 13 to be interconnected by removable fasteners as with the interconnection of the wall elements with the slip sheet element. The central panel 42 is provided with first and second side flaps 48 and 49, which overlie the doors 39 when the latter are in closed condition.

The strap elements 15 are preferably formed of webbing, each including first and second elongated members 53 and 54, the free ends 55 of which are secured to the rings 27. They are interconnected by a buckle 56, which permits them to be tensioned when the device 10 is in fully assembled condition.

Normally, the device 10 may be stored in collapsed condition for storage or return shipment. When use is required, the wall elements 12 and 13 are first assembled to the slip sheet element, and the roof element 14 installed thereupon. In this condition, the doors 39 may be opened and the device loaded to the limits of its capacity. The doors 39 are then closed, and the strap elements 15 positioned as shown in FIG. 1 and suitably tensioned.

It may thus be seen that I have invented novel and highly useful improvements in cargo containers for aircraft, which offer the advantages of a non-planar roof line, thus adapting them particularly for use within the cargo areas of aircraft, where the fuselage has an ovate or circular configuration. The entire device consists of a slip sheet element of known type, and three large blanks of corrugated cardboard, which are easily temporarily assembled or disassembled. As is desirable in devices of this type, when disassembled, the various elements may be placed in coplanar condition and stacked upon the pallet for storage or return shipment.

I wish it to be understood that I do not consider the invention to be limted to the precise details of structure shown and set forth in this specification, for obvious modifications will occur to those skilled in the art to which the invention pertains.

I claim:

1. An improved collapsible shipping container element of domed roof configuration including: a rigid planar slip sheet element; first and second wall elements, and a roof element; said slip sheet element including a peripheral edge, and having a plurality of ring members projecting upwardly from said edge; said wall elements each comprising a planar blank of corrugated material and including a side wall panel and first and second end wall panels foldably interconnected thereto, a door member foldably interconnected to a vertical edge of each of said end wall panels, said side wall panels being of rectangular configuration, said end wall panels having an angularly disposed upper edge and being of a height greater than said side wall panel; said roof element comprising a single blank of material and including a rectangular central roof panel positioned above said doors of said first and second wall elements, and first and second rectangular roof panels overlying the end walls of said first and second wall elements, said roof element having peripheral edge flap members overlying outer surfaces of said first and second wall elements for detachable interconnection therewith; and a plurality of strap elements interconnecting said rings on said slip sheet and passing over said roof and wall elements, serving to place said container under tension when in closed condition.

2. A shipping container in accordance with claim 1, further characterized in said strap elements in an engaged condition overlying said doors to maintain them in closed condition.

* * * * *